US009215526B2

(12) United States Patent
Chen et al.

(10) Patent No.: US 9,215,526 B2
(45) Date of Patent: Dec. 15, 2015

(54) CIRCUIT FOR MICROPHONE PIN ASSIGNMENT DETECTION AND METHOD THEREOF

(71) Applicant: WISTRON CORP., New Taipei (TW)

(72) Inventors: Pei-Lin Chen, New Taipei (TW); Hsin-Chun Lee, New Taipei (TW); Shou-Jung Chang, New Taipei (TW); Chia-Chien Feng, New Taipei (TW)

(73) Assignee: WISTRON CORP., New Taipei (TW)

( * ) Notice: Subject to any disclaimer, the term of this patent is extended or adjusted under 35 U.S.C. 154(b) by 93 days.

(21) Appl. No.: 14/227,656

(22) Filed: Mar. 27, 2014

(65) Prior Publication Data

US 2015/0156584 A1 Jun. 4, 2015

(30) Foreign Application Priority Data

Dec. 2, 2013 (TW) ..... 102144041 A

(51) Int. Cl.
*H04R 29/00* (2006.01)
*H04R 3/00* (2006.01)

(52) U.S. Cl.
CPC ..... *H04R 3/00* (2013.01); *H04R 29/004* (2013.01); *H04R 2420/05* (2013.01); *H04R 2420/09* (2013.01)

(58) Field of Classification Search
CPC .... H04R 3/00; H04R 1/1041; H04R 2420/05; H04R 29/00; H04R 29/004; H04R 5/033; H04R 2420/09; H01R 13/66; H01R 24/58; H01R 2107/00; H04M 1/6058; H04M 1/0274
USPC ..... 381/74, 56, 58
See application file for complete search history.

(56) References Cited

U.S. PATENT DOCUMENTS

| | | | | |
|---|---|---|---|---|
| 8,150,046 | B2 * | 4/2012 | Hansson et al. | 381/58 |
| 8,718,296 | B2 * | 5/2014 | Chang | 381/74 |
| 2012/0308041 | A1 | 12/2012 | Birch et al. | |
| 2013/0279713 | A1 * | 10/2013 | Xiao et al. | 381/74 |
| 2014/0050330 | A1 * | 2/2014 | Allen et al. | 381/74 |

OTHER PUBLICATIONS

Texas Instruments, "Dual 10-Ω SPDT Analog Switch", www.ti.com, SCDS165D—May 2004—Revised May 2008.
Fairchild Semiconductor Corporation, "Audio Jack Detection and Configuration, MIC / GND Cross Point Switch",www.fairchildsemi.com, Aug. 2012.
Texas Instruments,"LM193, LM293,LM293A, LM393, LM393A, LM2903, LM2903V, Dual Differential Comparators", www.jameco.com, SLCS005T—Jun. 1976—Revised Feb. 2007.

* cited by examiner

*Primary Examiner* — Vivian Chin
*Assistant Examiner* — Jason R Kurr
(74) *Attorney, Agent, or Firm* — Li & Cai Intellectual Property (USA) Office

(57) ABSTRACT

A circuit for detecting microphone pin assignment and method thereof is provided. The circuit includes a pin switch unit and a detection unit. The pin switch unit switches the pin assignment of a headset connector. The detection unit receives microphone signals and outputs a test voltage to the microphone. According to the voltage difference between the pins, the pin assignment of the headset is determined and the pin switch unit automatically switches to the correct pins.

9 Claims, 5 Drawing Sheets

CIRCUIT FOR MICROPHONE PIN ASSIGNMENT DETECTION AND METHOD THEREOF

BACKGROUND

1. Field of the Disclosure

The instant disclosure relates to a circuit for pin assignment detection; in particular, to a circuit for microphone pin assignment detection and method thereof.

2. Description of Related Art

Microphones come in all sorts of shape and size including moving-coil microphone, capacitor microphone, electret capacitor microphone, microelectromechanical microphone and aluminium ribbon microphone. The electret capacitive and the microelectromechanical account to capacitor microphones, while the manufacturing process and internal circuitry are different. Conventional consumer electronic products, for example, mobile phones, personal digital assistance and the like, adapt capacitor microphones.

A headset with 3.5 mm and 4 pins may employ two types of specification respectively. These two types include Open Mobile Terminal Platform (OMTP) and Cellular Telecommunications & Internet Association (CTIA). The difference between the OMTP and the CTIA arises from the pin assignment where the signal terminal and the ground terminal of the microphone connector may be reversed. Under inappropriate connection, it may result in failure of the microphone functions. Typically, it is overcome by a converter or a jumper.

Fairchild suggests a detection chip which detects and switches the pins. However, the detection chip requires an initializing signal from an external processor and includes an oscillator and a timer, which adds the complexity to the design.

BRIEF SUMMARY OF THE DISCLOSURE

The instant disclosure provides a circuit for microphone pin assignment detection and method thereof. The pin assignment is determined by detecting the component characteristics of a capacitor microphone, and an appropriate connection to a system is automatically routed.

An embodiment of the instant disclosure is a circuit for microphone pin assignment detection. The microphone includes a first signal output terminal and a second signal output terminal. An electric signal between the first and second signal output terminals corresponds to an audio signal received by the microphone. The circuit includes a pin switch unit and a detection unit. The circuit includes the pin switch unit, the detection unit, a fifth switch, a microphone output terminal and a ground output terminal.

The pin switch unit includes a first input terminal, a second input terminal, a first output terminal and a second output terminal. The first input terminal is coupled to the first signal output terminal, while the second output terminal is coupled to the second signal output terminal. According to a control signal the pin switch unit conducts the first input terminal or the second input terminal to the first output terminal and the second input terminal or the first input terminal to the second output terminal. The detection unit includes an impedance element. The detection unit provides a test voltage to the first output terminal through the impedance element, adjusts the control signal according to an output voltage between the first output terminal and the second output terminal and holds the control signal according to a pin insertion signal.

If the pin switch unit conducts the first input terminal to the first output terminal, the pin switch unit conducts the second input terminal to the second output terminal. Alternatively, when the pin switch unit conducts the first input terminal to the second output terminal, the pin switch unit conducts the second input terminal to the first output terminal.

The detection unit compares the output voltage with a first reference voltage. If the output voltage is greater than the first reference voltage, the pin switch unit remains at existing routing state. If the output voltage is smaller than the first reference voltage, the pin switch unit alters current routing state.

The pin switch unit includes a first switch and a second switch. The first switch is coupled to the first input terminal, the second input terminal and the first output terminal for conducting the first input terminal or the second input terminal to the first output terminal. The second switch is coupled to the first input terminal, the second input terminal and the second output terminal for conducting the first input terminal or the second input terminal to the second output terminal. The first switch and the second switch are regulated by the control signal.

The detection unit includes a third switch, a fourth switch, a comparator, a first delay unit, a second delay unit, a first latch and a second latch. The third switch is coupled between the second output terminal and a ground contact. The fourth switch is coupled between the impedance element and the test voltage. The comparator has a non-inverse input terminal, an inverse input terminal and an output terminal. The non-inverse input terminal is coupled to the first output terminal, while the inverse output terminal is coupled to a first reference voltage. The first delay unit is coupled to the output terminal of the comparator, the third switch and the fourth switch. The second delay unit is coupled to the first delay unit. The first latch is coupled to the output terminal of the comparator and the pin switch unit. The first latch holds and transmits the control signal according to the pin insertion signal. The second latch is coupled to the second delay unit and a fifth switch. The second latch holds and transmits the control signal according to the pin insertion signal. The comparator outputs the control signal and transmits the control signal to the pin switch unit through the first latch. The first delay unit outputs the control signal to the third switch and the fourth switch, and the second latch transmits the control signal to the fifth switch.

According to another embodiment of the instant disclosure, a method of detecting microphone pin assignment is provided. The microphone has a first signal output terminal and a second signal output terminal. A voltage signal between the first signal output terminal and the second signal output terminal corresponds to an audio signal received by the microphone. The method includes the following step. Firstly, a test voltage is output from an impedance element to the first signal output terminal or the second signal output terminal. Then, a control signal is output according to the voltage signal between the first signal output terminal and the second signal output terminal. Subsequently, the first signal output terminal or the second signal output terminal is conducted to a microphone output terminal according to the control signal. The first signal output terminal or the second signal output terminal is then conducted to a ground output terminal according to the control signal. If the first signal output terminal is routed to the microphone output terminal, the second signal output terminal is conducted to the ground output terminal. On the other hand, if the second signal output terminal is routed to the microphone output terminal, the first signal output terminal is routed to the ground output terminal.

In summary, according to the characteristics of the microphone component, the drain electrode and the source electrode of the field effect transistor can be used to determine the signal assignment and automatically switch the associated pin connection, therefore adapted to both the OMTP and CTIA headsets.

In order to further understand the instant disclosure, the following embodiments are provided along with illustrations to facilitate the appreciation of the instant disclosure; however, the appended drawings are merely provided for reference and illustration, without any intention to be used for limiting the scope of the instant disclosure.

DETAILED DESCRIPTION OF THE DISCLOSURE

The aforementioned illustrations and following detailed descriptions are exemplary for the purpose of further explaining the scope of the instant disclosure. Other objectives and advantages related to the instant disclosure will be illustrated in the subsequent descriptions and appended drawings.

First Embodiment

Figure 1A:
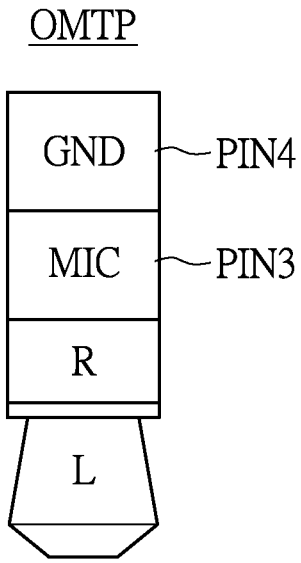
FIG. 1A depicts an OMTP microphone connector.
Figure 1B:
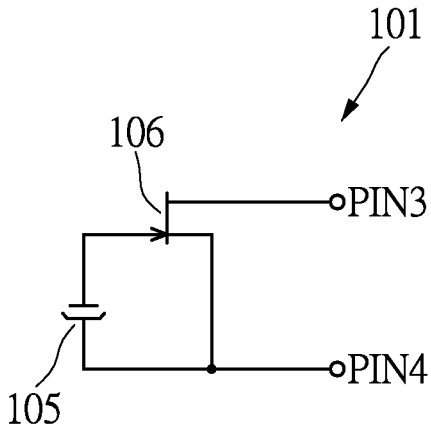
FIG. 1B is a equivalent circuit schematic of an OMTP microphone.

Please refer to FIG. 1A in conjunction with FIG. 1B. FIG. 1A depicts an OMTP microphone connector. FIG. 1B is a circuit schematic of an OMTP microphone. As shown in FIG. 1A, the connector has four pins: left speaker channel L, right speaker channel R, microphone MIC and ground GND. The microphone MIC is designated as a third pin PIN3, and the ground GND is designated as a fourth pin PIN4. As shown in FIG. 1B, the equivalent circuit of a capacitor microphone 101 consists of a field effect transistor 106 and a capacity 105. The capacity 105 is coupled to the gate electrode and the source electrode of the field effect transistor 106. The drain electrode of the field effect transistor 106 is coupled to the third pin PIN3, while the source electrode of the field effect transistor is coupled to the fourth pin PIN4.

Figure 1C:
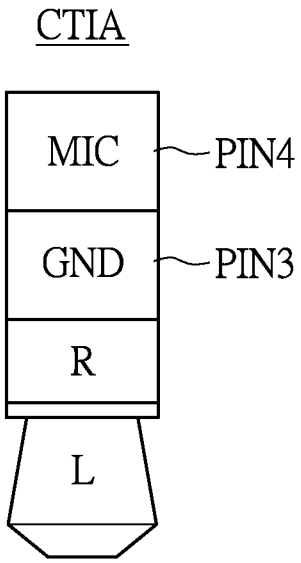
FIG. 1C depicts a CTIA microphone connector.
Figure 1D:
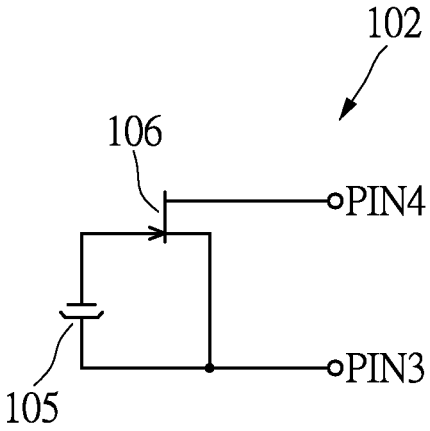
FIG. 1D is a equivalent circuit schematic of a CTIA microphone.

Please refer to FIG. 1C in conjunction with FIG. 1D. FIG. 1C depicts a CTIA microphone connector. FIG. 1D is an equivalent circuit schematic of a CTIA microphone. As shown in FIG. 1C, the connector has four pins: left speaker channel L, right speaker channel R, microphone MIC and ground GND. The microphone MIC is designated as the fourth pin PIN4, and the ground GND is designated as the third pin PIN3. As shown in FIG. 1D, the equivalent circuit of a capacitor microphone 101 consists of a field effect transistor 106 and a capacity 105. The capacity 105 is coupled to the gate electrode and the source electrode of the field effect transistor 106. The drain electrode of the field effect transistor 106 is coupled to the fourth pin PIN4, while the source electrode of the field effect transistor is coupled to the third pin PIN3.

It should be understood that the difference between OMTP and CTIA microphones is that the third pin PIN3 and the fourth pin PIN4 are reversed, and therefore two types of headsets may not be appropriately recognized.

In the instant embodiment, the third pin PIN3 and the fourth pin PIN4 are the two signal terminals of the microphone. For example, the third pin PIN3 represents a first signal output terminal of the microphone, while the fourth pin PIN4 represents a second signal output terminal of the microphone. An electric signal (e.g., voltage) between the first and second signal output terminals corresponds to an audio signal received by the microphone. In other words, for an OMTP microphone, the first and second signal output terminals are microphone pin MIC and ground GND respectively. For a CTIA microphone, the first and second output terminals are ground GND and microphone MIC respectively. Likewise, the third pin PIN3 may represent the second signal output terminal of the microphone, while the fourth pin PIN4 may represent the first signal output terminal of the microphone, and the instant embodiment is not limited thereto.

A circuit for microphone pin assignment detection in accordance with the instant embodiment is used to detect whether the third pin PIN3 and the fourth PIN 4 correspond to the microphone MIC or ground GND respectively and switch to correct configuration for transmitting correction signal to the backend system. The circuit for microphone pin assignment may be disposed at the server end, for example, mobile phone, laptop, tablet, desktop and the like. On the other hand, the circuit may be disposed in the headset. In the instant embodiment, the circuit is disposed at the server end, and the instant disclosure is not limited thereto.

Figure 2A:
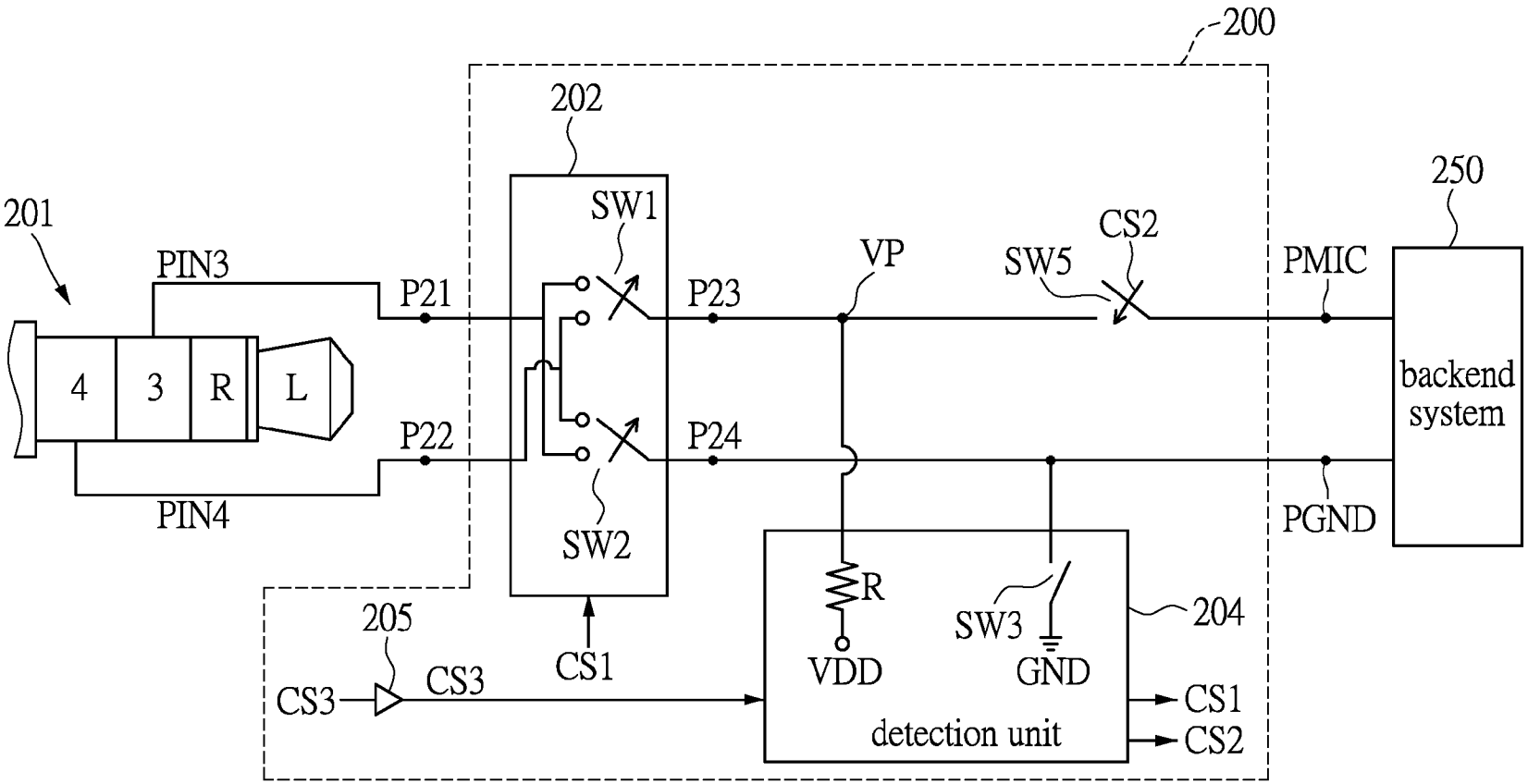
FIG. 2A shows a block diagram of a circuit for microphone pin assignment detection in accordance with a first embodiment of the instant disclosure.

Please refer to FIG. 2A. FIG. 2A shows a block diagram of the circuit for microphone pin assignment detection in accordance with the first embodiment of the instant disclosure. The circuit 200 may include a headset socket having insertion detection pin (not shown). The circuit 200 determines whether the headset is inserted or not by a signal created when a headset connector 201 mates with the headset socket. The pin insertion signal is designated as CS3. The pin insertion signal CS3 may be transmitted to a detection unit 204 after a delay period through a buffer 205. The buffer 205 may be disposed in the circuit 200 or coupled externally. The pin insertion signal CS3 may be generated by the headset or a sensing circuit from the server end. The pin insertion signal serves as an indicator of the headset insertion. The pin insertion signal may be generated by other ways, yet the pin insertion signal is the key indicator when it comes to holding the correct conduction path. According to the delayed pin insertion signal CS3, the circuit 200 can direct a pin switch unit 202 to the correct route after pin assignment is determined.

After the headset connector 201 is inserted to the headset socket, the circuit 200 detects the pin assignment (microphone MIC or ground GND) of the third pin PIN3 and fourth pin PIN4 and then switch correct signal to a backend system 250. In other words, the circuit 200 determines which one of the third and fourth pins PIN3, PIN4 is the microphone MIC and routes the pin to a microphone output terminal PMIC. Likewise, the circuit 200 determines which one of the third and fourth pins PIN3, PIN4 is the ground GND and routes the pin to a ground output terminal PGND. After detection and switch, the system 250 obtains signals of the microphone MIC from the microphone output terminal PMIC and conducts to the ground GND of the microphone via the ground output terminal PGND.

The circuit 200 for microphone pin assignment detection includes the pin switch unit 202, the detection unit 204 and a fifth switch SW5. The pin switch unit 202 is coupled to the third and fourth pins PIN3, PIN4 of the headset connector 201 through the headset socket. Furthermore, according to a control signal CS1 output by the detection unit 204, the pin switch unit 202 routes one of the third pin PIN3 and the fourth pin PIN4 (i.e., the microphone MIC) to a first output terminal P23 and the other pin (i.e., the ground GND) to the second output terminal P24.

The detection unit 204 is coupled to the first output terminal P23 and the second output terminal P24 of the pin switch unit 202. The detection unit 204 outputs a test voltage VDD from an impedance element (e.g., resistor R) to the first output terminal P23. Additionally, the pin switch unit 202 adjusts the control signal CS2 according to an output voltage from the first output terminal P23 and the second output terminal P24. The first and second output terminals P23, P24 are coupled to the first and second signal output terminals of the microphone through the pin switch unit 202 and serve to output the voltage between the drain electrode and the source electrode of the field effect transistor of the microphone. In other words, the detection unit 204 determines which one of the third pin PIN3 and the fourth pin PIN4 is the microphone MIC and the ground GND respectively according to the voltage difference between the drain electrode and the source electrode of the field effect transistor 106 of the microphone. Then, the detection unit 204 outputs the control signal CS1 to the pin switch unit 202 according to the detection result, and the pin switch is carried out.

The fifth switch SW5 is coupled between the first output terminal P23 and the microphone output terminal PMIC and controlled by the control signal CS2 output by the detection unit 204. The fifth switch SW5 is not connected when the detection unit 204 undergoes pin assignment detection. After the pin assignment is determined by the detection unit, the fifth switch SW5 is then conducted so as to avoid the circuit 200 affecting the backend system 250 operation.

Figure 2B:
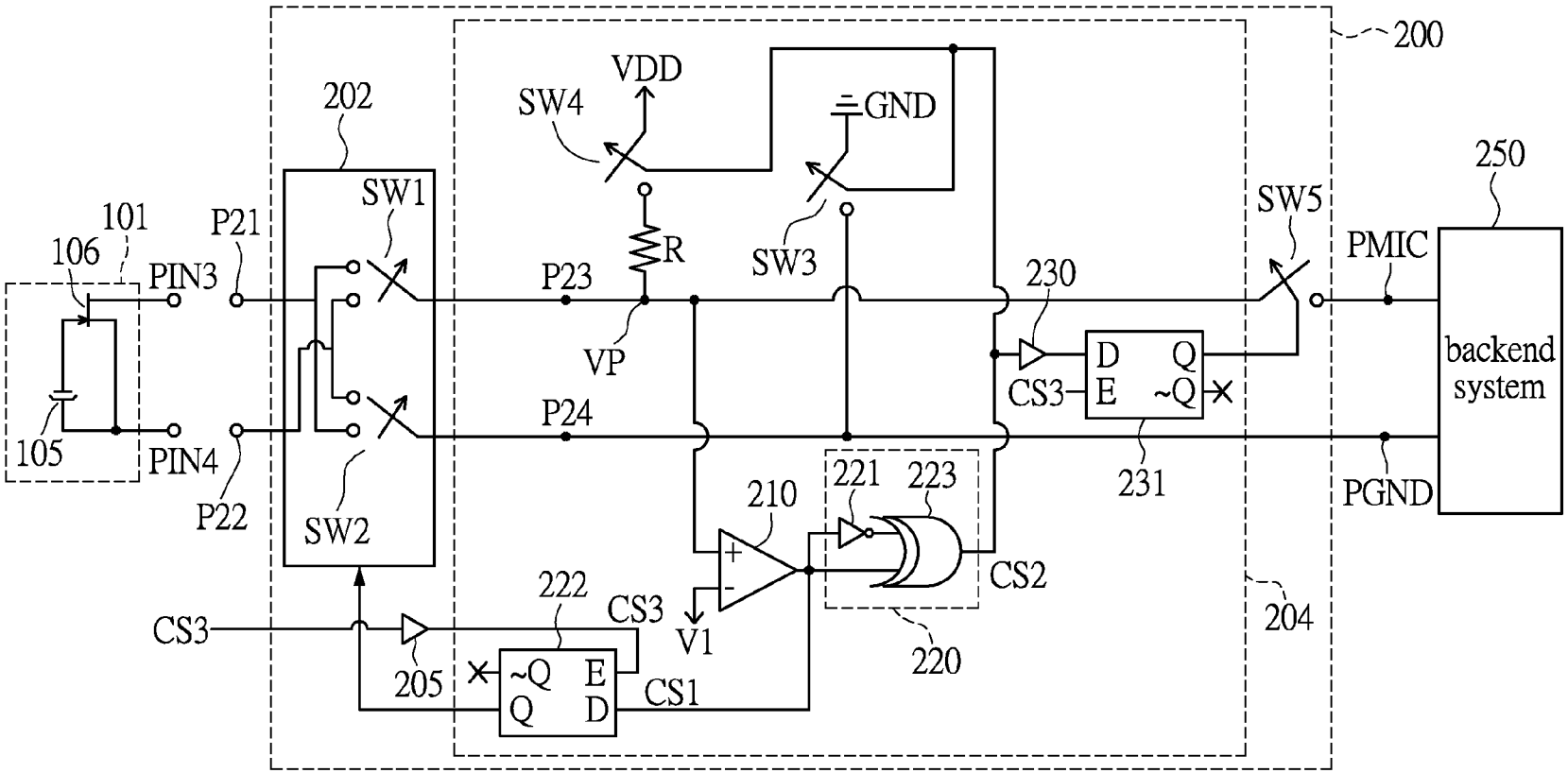
FIG. 2B is a circuit schematic of a circuit for microphone pin assignment detection in accordance with a first embodiment of the instant disclosure.

Please refer to FIG. 2A in conjunction with FIG. 2B. FIG. 2B is a circuit schematic of the circuit for microphone pin assignment detection in accordance with the first embodiment of the instant disclosure. The equivalent circuit of OMTP capacitor microphone 101 in FIG. 1B is used as an example in FIG. 2B. The drain electrode of the field effect transistor 106 of the capacitor microphone 101 is connected to the third pin PIN3 of the headset connector 202, while the source electrode is connected to the fourth pin PIN4. In other words, the third pin PIN3 is microphone MIC, and the fourth pin PIN4 is ground GND.

The pin switch unit 202 includes a first input terminal P21, a second input terminal P22, the first output terminal P23 and the second output terminal P24. The first input terminal P21 is coupled to the first signal output terminal (i.e., the third pin PIN3 of the headset connector 201) of the microphone. The second input terminal P22 is coupled to the second signal output terminal (i.e., the fourth pin PIN4 of the headset connector 201) of the microphone. The pin switch unit 202 includes a first switch SW1 and a second switch SW2. The first and second switches SW1, SW2 both have three terminals. A first end of the first switch SW1 is coupled to the first input terminal P21, a second end thereof is coupled to the second input terminal P22, and a third end thereof is coupled to the first output terminal P23. According to the control signal, the first input terminal P21 or the second input terminal P22 is routed to the first output terminal P23. A first end of the second switch SW2 is coupled to the third pin PIN3, a second end thereof is coupled to the fourth pin PIN4, and a third end thereof is coupled to the first output terminal P23. According to the control signal CS1, the first input terminal P21 or the second input terminal P22 is routed to the second output terminal P24.

If the pin switch unit 202 conducts the first input terminal P21 to the first output terminal P23, the second input terminal P21 is routed to the second output terminal P24. If the pin switch unit 202 conducts the first input terminal P21 to the second output terminal P24, the second input terminal P22 is routed to the first output terminal P23.

The detection unit 204 includes a comparator 210, a first delay unit 220, the third switch SW3, the fourth switch SW4, a resistor R, a first latch 222, a second latch 213 and a second delay unit 230. The comparator 210 has a non-inverse input terminal, an inverse input terminal and an output terminal. The non-inverse input terminal of the comparator is coupled to the first output terminal P23, while the inverse input terminal thereof is coupled to a first reference voltage V1. The first delay unit 220 includes a NOT gate 221 and an exclusive OR (XOR) gate 223. Two input terminals of the XOR gate 223 are coupled to the output terminal of the comparator 210 and the output terminal of the NOT gate 221 respectively. The output terminal of the comparator 210 is coupled to the input terminal of the NOT gate 221. Furthermore, the NOT gate 221 outputs an inverse signal to one of the input terminal of the XOR gate 223. The arrangement of this circuitry allows a shut down signal to be transmitted to the third and fourth switches SW3, SW4 regardless the results obtained from the comparator 210. The output terminal of the first delay unit 220 is coupled to the control terminal of the third and fourth switches SW3, SW4. The input terminal of the second delay unit 230 is coupled to the first delay unit 220 for delaying the control signal CS2 and regulating the fifth switch SW5. The resistor R is coupled between the fifth switch SW5 and the first output terminal P23. The other end of the fifth switch SW5 is coupled to the test voltage VDD. The third switch SW3 is coupled between the ground GND and the second output terminal P24. The third, fourth and fifth switches SW3, SW4, sW5 are regulated by the control signal CS2.

It should be noted that an enable terminal E of the first latch 222 receives the pin insertion signal CS3, and a pin D of the first latch 222 receives the control signal CS1. A pin Q of the second latch 231 is coupled to the pin switch unit 202. The first latch 222 is couple between the comparator 210 and the pin switch unit 202. According to the relayed pin insertion signal CS3 and the latch control signal CS1, the microphone pin assignment is determined and the pin switch unit 202 may remain its route. A pin E of the second latch 231 receives the pin insertion signal CS3, and a pin Q of the second latch 231 is coupled to the fifth switch SW5. The second latch 231 is coupled between the second buffer unit 230 and the switch SW5. According to the relayed pin insertion signal CS3 and the latch control signal CS2, the microphone pin assignment is determined and the fifth switch SW5 may remain conducted. In the instant embodiment, the first and second latches 222, 231 are D flip-flop, and the instant disclosure is not limited thereto.

After the detection unit 204 determines the microphone pin assignment, the first and second latches 222, 231 serve to transmit and hold the correct control signals CS1, CS2. Therefore, the fifth switch SW5 and the pin switch unit 202 remain at the correct route. The pin insertion signal CS3 received by the first and second latches 222, 231 is delayed so as to allow the determination of the microphone pin assignment to be completed. Then, the control signals CS1, CS2 are transmitted to the pin switch unit 202 and the fifth switch SW5. After the pin switch, the changes of the control signals CS1, CS2 do not affect the pin switch unit 202 until the first and second latches 222, 231 are triggered again. Once the first and second latches 222, 231 start a new cycle, the signal over the Q pin is renewed and the routing of the pin switch unit 202 is rearranged.

When the capacitor microphone 101 connects to the circuit 200 through the headset connector 201, the pin switch unit 202 remains at existing state. For example, given that the first input terminal P21 is routed to the first output terminal P23, and the second input terminal P22 is routed to the second output terminal P24. Meanwhile, the fifth switch SW5 is not conducted, while the third switch SW3 and the fourth switch SW4 are conducted. The test voltage VDD, resistor R and the capacitor microphone 101 together form a loop. More specifically, an output voltage VP generated between the first and second output terminals P23, P24 reflects the voltage difference between the drain and source electrodes of the field effect transistor 106.

As shown in FIG. 2B, the comparator 210 serves to compare the output voltage VP of the first output terminal P23 and the reference voltage V1. If the output voltage VP is greater than the first reference voltage V1, the pin switch unit 202 remains at the existing state. If the output voltage VP is smaller than the first reference voltage V1, the pin switch unit 202 changes its existing state. The first delay unit 220 delays the transmission of the control signal CS1, such that the control signal CS2 is transmitted to the third and fourth switches SW3, SW4. The third and fourth switches SW3, SW4 will then turn off (i.e., not conducted) in response to the control signal CS2, and the fifth switch SW5 will turn on after a period because of the second delay unit 230. Once the fifth switch SW5 is conducted, the first output terminal P23 is routed to the microphone output terminal PMIC. Meanwhile, the headset socket detection result (i.e., the pin insertion signal CS3 transmitted by the buffer 205) is delayed for a period and then received by the control pin (i.e., pin E) of the first and second latches 222, 231. The control signals CS1, CS2 are received by the data pin (i.e., pin D) of the first and second latches 222, 231. The detection result of the headset insertion is a fixed value, such that the state of the first and second latches remains the same until the headset connector is unplugged. Therefore, after the first cycle of pin assignment detection, control signals CS1, CS2 do not change until the headset connector is removed from the socket. After the headset is unplugged, the state of the headset socket changes and this alternation serves as a signal for returning to default configuration to all the switches (SW1-5) of the circuit 200.

If the first output terminal P23 is coupled to the ground GND (i.e., the fourth pin PIN4 of the headset connector 201) of capacitor microphone 101, the output voltage VP is smaller than the first reference voltage V1. Therefore, the comparator 210 outputs the control signal CS1 having logic low voltage to the pin switch unit 202 so as to change the existing routing. When the pin switch unit 202 switches the first output terminal P23 to the microphone pin MIC of the capacitor microphone (i.e., the third pin PIN3 of the headset connector 201), the detection unit 204 outputs the control signal CS1 having high logic voltage and keeps the pin switch module at its existing state. The third switch SW3, fourth switch SW4 and fifth switch SW5 are switched off in succession. The first and second latches 222, 231 hold the states of the switches before the headset connector is unplugged.

Similarly, when the headset connector 201 is a CTIA microphone and connected to the circuit 200, the output voltage VP will have higher voltage level as the first output terminal P23 coupled to the third pin PIN3. In this regard, the pin switch unit 202 routes the first output terminal P23 to the fourth pin PIN4 for correctly transferring microphone signals to the backend system 250.

Accordingly, the detection unit 204 can detect the voltage difference between the first and second output terminals P23, P24, determines whether the pin switch unit 202 correctly routes the first output terminal P23 to the microphone pin MIC and regulates the correct routing between the pin switch unit 202 and the backend system 250. The automatic detection of the OMTP and CTIA microphone connector is then complete.

It should be noted that in FIG. 2B, the XOR gate and the NOT gate are components of the first delay unit 220. However, the instant embodiment does not intend to limit the scope of the instant disclosure. Other components or logic circuit, for example, a buffer, a delay device may also be employed, and the instant disclosure is not limited thereto. In the instant embodiment, the second delay unit 230 is composed of the buffer which delays the conduction time of the fifth switch SW5 and avoids signal misjudgment by the backend system 250. However, the first and second delay units 220, 230 are optional components that may be omitted to meet design requirement.

Second Embodiment

Figure 3:
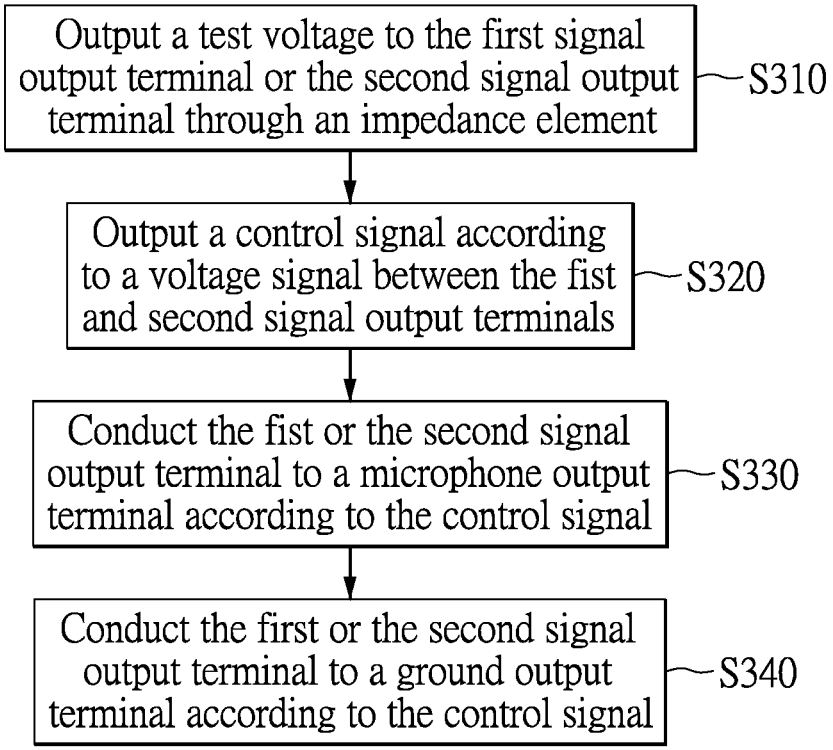
FIG. 3 shows a flow chart of a method of microphone pin assignment detection in accordance with a second embodiment of the instant disclosure.

According to the first embodiment, a method of detecting microphone pin assignment is provided. The method detects and automatically switches between OMTP and CTIA microphone connector. Please refer to the first embodiment and FIG. 3. FIG. 3 shows a flow chart of the method of detection microphone pin assignment in accordance with a second embodiment of the instant disclosure. The microphone has two signal output terminals (MIC and GND). Firstly, the detection unit 204 outputs a test voltage VDD through the impedance element to the first or second signal output terminal (step S310). Subsequently, the detection unit 204 outputs a control signal CS1 according to the voltage signal (i.e., the voltage level of the output voltage VP) between the first and second signal output terminals (step S320). Then, according to the control signal CS1, the first or second signal output terminal is routed to the microphone output terminal PMIC. Furthermore, the first or second signal output terminal is routed to the ground output terminal PGND also according to the control signal CS1.

If the first signal output terminal is routed to the microphone output terminal PMIC, the second signal output terminal is routed to the ground output terminal PGND. Alternatively, if the second signal output terminal is routed to the microphone output terminal PMIC, the first signal output terminal is routed to the ground output terminal PGND.

In the instant embodiment, the detection method mainly relies on the voltage difference to determine whether the pin is a microphone MIC or the ground GND. More specifically, the voltage difference is created between the drain electrode and the source electrode of a field effect transistor of a capacitor microphone when under one state (the power coupled to the microphone MIC) or another state (the power coupled to the ground GND). Consequently, the correct pin is routed to the output pins of the backend system, such that the circuit achieves automatic detection and switching.

A person skill in the art should be able to understand the method of microphone pin assignment detection according to the abovementioned procedure. Further details are not elaborated hereinafter.

In short, the method of microphone pin assignment detection uses the characteristic of the capacitor microphone to achieve automatic pin assignment detection and switching and route appropriate signal path so as to correctly conduct the OMTP and CTIA microphone connectors.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A circuit for microphone pin assignment detection, the microphone including at least a first signal output terminal and a second signal output terminal, an electric signal between the first signal output terminal and the second signal output terminal corresponding to an audio signal received by the microphone, the circuit for microphone pin assignment detection comprising:

a pin switch unit including a first input terminal, a second input terminal, a first output terminal and a second output terminal, the first input terminal coupled to the first signal output terminal, the second output terminal coupled to the second signal output terminal, according to a control signal the pin switch unit configuring the first input terminal or the second input terminal to the first output terminal and the second input terminal or the first input terminal to the second output terminal; and a detection unit including an impedance element, the detection unit providing a test voltage to the first output terminal through the impedance element, adjusting the control signal according to an output voltage between the first output terminal and the second output terminal and holding the control signal according to a pin insertion signal, wherein the detection unit comprises:

a first switch coupled between the second output terminal and a ground contact;

a second switch coupled between the impedance element and the test voltage;

a comparator having a non-inverse input terminal, an inverse input terminal and an output terminal, the non-inverse input terminal coupled to the first output terminal, and the inverse output terminal coupled to a first reference voltage;

a first delay unit coupled to the output terminal of the comparator, the first switch and the second switch;

a second delay unit coupled to the first delay unit;

a first latch coupled to the output terminal of the comparator and the pin switch unit, the first latch holding and transmitting the control signal according to the pin insertion signal; and a second latch coupled to the second delay unit and a third switch, the second latch holding and transmitting the control signal according to the pin insertion signal;

wherein the comparator outputs the control signal and transmits the control signal to the pin switch unit through the first latch, the first delay unit outputs the control signal to the first switch and the second switch, and the second latch transmits the control signal to the third switch.

2. The circuit for microphone pin assignment detection according to claim 1, wherein when the pin switch unit conducts the first input terminal to the first output terminal, the pin switch unit conducts the second input terminal to the second output terminal, and when the pin switch unit conducts the first input terminal to the second output terminal, the pin switch unit conducts the second input terminal to the first output terminal.

3. The circuit for microphone pin assignment detection according to claim 1, wherein the detection unit compares the output voltage with the first reference voltage, if the output voltage is greater than the first reference voltage, the pin switch unit remains at existing routing state, and if the output voltage is smaller than the first reference voltage, the pin switch unit alters current routing state.

4. The circuit for microphone pin assignment detection according to claim 1, wherein the pin switch unit includes:

a fourth switch coupled to the first input terminal, the second input terminal and the first output terminal for conducting the first input terminal or the second input terminal to the first output terminal; and a fifth switch coupled to the first input terminal, the second input terminal and the second output terminal for conducting the first input terminal or the second input terminal to the second output terminal;

wherein the fourth switch and the fifth switch are regulated by the control signal.

5. The circuit for microphone pin assignment detection according to claim 1, wherein the first delay unit includes:

an exclusive OR gate having a first input end coupled to the output terminal of the comparator; and a NOT gate coupled between the output terminal of the comparator and a second input end of the exclusive OR gate.

6. The circuit for microphone pin assignment detection according to claim 1 further comprising:

the third switch coupled between a microphone output terminal and the first output terminal; and a ground output terminal coupled to the second output terminal.

7. The circuit for microphone pin assignment detection according to claim 1, wherein the impedance element is a resistor, one end of the resistor is coupled to the first output terminal, and the other end of the resistor is coupled to the test voltage through the second switch.

8. The circuit for microphone pin assignment detection according to claim 1, wherein the microphone is a capacitor microphone.

9. A method of detecting microphone pin assignment by using a circuit for microphone pin assignment detection, the microphone having a first signal output terminal and a second signal output terminal, a voltage signal between the first signal output terminal and the second signal output terminal corresponding to an audio signal received by the microphone, the method comprising:

outputting a test voltage from an impedance element to the first signal output terminal or the second signal output terminal;

outputting a control signal according to the voltage signal between the first signal output terminal and the second signal output terminal;

conducting the first signal output terminal or the second signal output terminal to a microphone output terminal according to the control signal; and conducting the first signal output terminal or the second signal output terminal to a ground output terminal according to the control signal;

wherein if the first signal output terminal is routed to the microphone output terminal, the second signal output terminal is conducted to the ground output terminal, and if the second signal output terminal is routed to the microphone output terminal, the first signal output terminal is routed to the ground output terminal;

wherein the circuit for microphone pin assignment detection comprising:

a pin switch unit including a first input terminal, a second input terminal, a first output terminal and a second output terminal, the first input terminal coupled to the first signal output terminal, the second output terminal coupled to the second signal output terminal, according to the control signal the pin switch unit configuring the first input terminal or the second input terminal to the first output terminal and the second input terminal or the first input terminal to the second output terminal; and a detection unit including the impedance element, the detection unit providing the test voltage to the first output terminal through the impedance element, adjusting the control signal according to an output voltage between the first output terminal and the second output terminal and holding the control signal according to a pin insertion signal, wherein the detection unit comprises:

a first switch coupled between the second output terminal and a ground contact;

a second switch coupled between the impedance element and the test voltage;

a comparator having a non-inverse input terminal, an inverse input terminal and an output terminal, the non-inverse input terminal coupled to the first output terminal, and the inverse output terminal coupled to a first reference voltage;

a first delay unit coupled to the output terminal of the comparator, the first switch and the second switch;

a second delay unit coupled to the first delay unit;

a first latch coupled to the output terminal of the comparator and the pin switch unit, the first latch holding and transmitting the control signal according to the pin insertion signal; and a second latch coupled to the second delay unit and a third switch, the second latch holding and transmitting the control signal according to the pin insertion signal;

wherein the comparator outputs the control signal and transmits the control signal to the pin switch unit through the first latch, the first delay unit outputs the control signal to the first switch and the second switch, and the second latch transmits the control signal to the third switch.

* * * * *